US006692340B1

(12) United States Patent
Williams

(10) Patent No.: US 6,692,340 B1
(45) Date of Patent: Feb. 17, 2004

(54) BLAST WHEEL HOUSING

(76) Inventor: Hershell E. Williams, 16 Glenview Dr., Alexandria, AL (US) 36250

( * ) Notice: Subject to any disclaimer, the term of this patent is extended or adjusted under 35 U.S.C. 154(b) by 0 days.

(21) Appl. No.: 10/359,356

(22) Filed: Feb. 5, 2003

(51) Int. Cl.[7] ..... B24C 3/00
(52) U.S. Cl. ..... 451/95; 451/451; 451/75; 72/53
(58) Field of Search ..... 451/89, 75, 86, 451/94, 95, 97, 102, 451; 72/53

(56) References Cited

U.S. PATENT DOCUMENTS 1,642,289 A * 9/1927 Arduser ..... 451/82
1,918,653 A * 7/1933 Martin ..... 451/82
2,307,816 A * 1/1943 Zimmerman et al. ..... 451/3
2,353,588 A * 7/1944 Rosenberger et al. .... 248/279.1
2,489,877 A * 11/1949 Fowler ..... 451/84
2,968,086 A * 1/1961 Fuchs ..... 72/53
3,368,308 A * 2/1968 Physioc, III ..... 451/2
3,546,816 A * 12/1970 Enegren ..... 451/86
4,291,509 A * 9/1981 Schulte et al. ..... 451/95
4,759,156 A * 7/1988 Baumgart ..... 451/95
4,979,338 A * 12/1990 Schmitz et al. ..... 451/86
5,024,028 A * 6/1991 Pierce et al. ..... 451/95
5,076,028 A * 12/1991 McDade ..... 451/95
5,769,693 A * 6/1998 Wadephul ..... 451/95
5,779,524 A * 7/1998 Swain ..... 451/102
5,888,125 A * 3/1999 Kuehn ..... 451/95
6,609,960 B2 * 8/2003 Rogmark ..... 451/88

* cited by examiner

*Primary Examiner*—George Nguyen
(74) *Attorney, Agent, or Firm*—Rodgers & Rodgers

(57) ABSTRACT

A blast wheel housing comprising front and rear walls, a pair of end walls integrally joined along adjacent edges to the front and rear walls, a top secured to the upper edges of the walls, an opening formed in the front wall, an access door hingedly connected to the front wall so as to selectively close the opening, an aperture formed in the access door, and a feed chute detachably secured to the access door for the purpose of feeding shot through the aperture.

4 Claims, 2 Drawing Sheets

BLAST WHEEL HOUSING

BACKGROUND OF THE INVENTION

Blast wheel technology is well known wherein shot is directed toward material to be treated by feeding the shot through an impeller onto a set of spinning blades. Of course, the blades accelerate the shot so as to achieve the desired deburring of the material situated in the blast machine. Naturally, over time the constant impinging of shot on the blades causes wear to the point that the blades must be replaced. Typically, the blast wheel housing is positioned on the blast machine in such a manner that access thereto is quite awkward.

In order to gain access to the interior of known housings, the top is removed and the sides of the housing are rotated downwardly such that access to the blades and other wearable parts is attained for purposes of removal and replacement. This is an arduous process typically requiring two persons working one-half of a day each to open the housing, replace the worn parts and close the housing.

BRIEF SUMMARY OF THE INVENTION

A housing for a blast wheel comprising a front wall, a rear wall, and a pair of end walls extending upwardly from a baseplate, the top secured in abutting relationship with the upper edges of the walls to form an enclosure, a blast wheel rotatably disposed in the enclosure, an opening formed in the front wall to provide access to the enclosure, an access door connected to the front wall to provide closure means for the opening, an aperture formed in the access door, and a feed chute detachably secured to the access door for feeding shot through the aperture and toward the blast wheel.

DETAILED DESCRIPTION OF THE INVENTION

Figure 1:
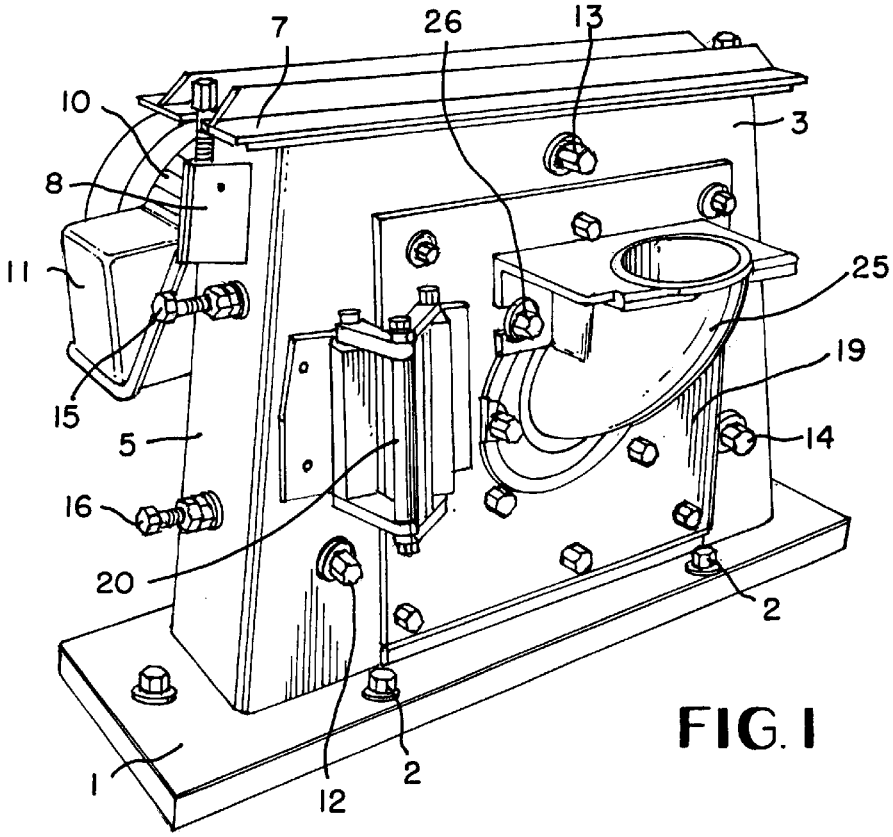
FIG. 1 is a perspective view of a blast wheel housing according to this invention.

In the drawings, the numeral 1 designates the housing baseplate which is secured to the blast wheel machine by means of multiple stud and nut assemblies 2. Front wall 3 and rear wall 4 together with end walls 5 and 6 are joined to baseplate 1 and extend upwardly therefrom. Front wall 3 and rear wall 4 are integrally joined to the associated adjacent edges of side walls 5 and 6 and, together with top 7, complete the basic elements of the housing. Top 7 is held in place by means of latching bar mechanisms 8 and 9, as is well known. For the purpose of rotating the blast wheel, drive motor 10 is provided with associated electronics disposed in box 11.

As is well known in the art, the interior of the blast wheel housing is provided with multiple protective liners with a front liner (not shown) disposed in face contacting relation with front wall 3 and secured in place by means of bolts 12, 13 and 14. A corresponding liner is disposed in face contacting relation with rear wall 4 and secured thereto by identical bolt, not shown in the drawings. The end liners (not shown) are held in position at one end of the housing by means of bolts 15 and 16 with the opposite end liner being secured in place at the opposite end wall by means of bolts 17 and 18.

According to this invention, access door 19 is rotatably attached to front wall 3 by means of hinge assembly 20. Access door 19 covers a corresponding opening in front wall 3 and, when the blast wheel is in operation, is securely closed by means of stud and nut assemblies 21–24. For the purpose of directing shot toward the blast wheel, feed chute 25 is provided and is detachably secured to access door 19 by means of nut and washer assemblies 26 and 27. For the purpose of securing control cage adapter plate 28 to the backside of access door 19 nut and washer assemblies 26, 27, 29 and 30 are provided. Assemblies 26 and 27 are removed in FIG. 2 and the studs are longer than the studs of assemblies 29 and 30 because assemblies 26 and 27 serve the additional purpose of securing feed chute 25.

Figure 2:
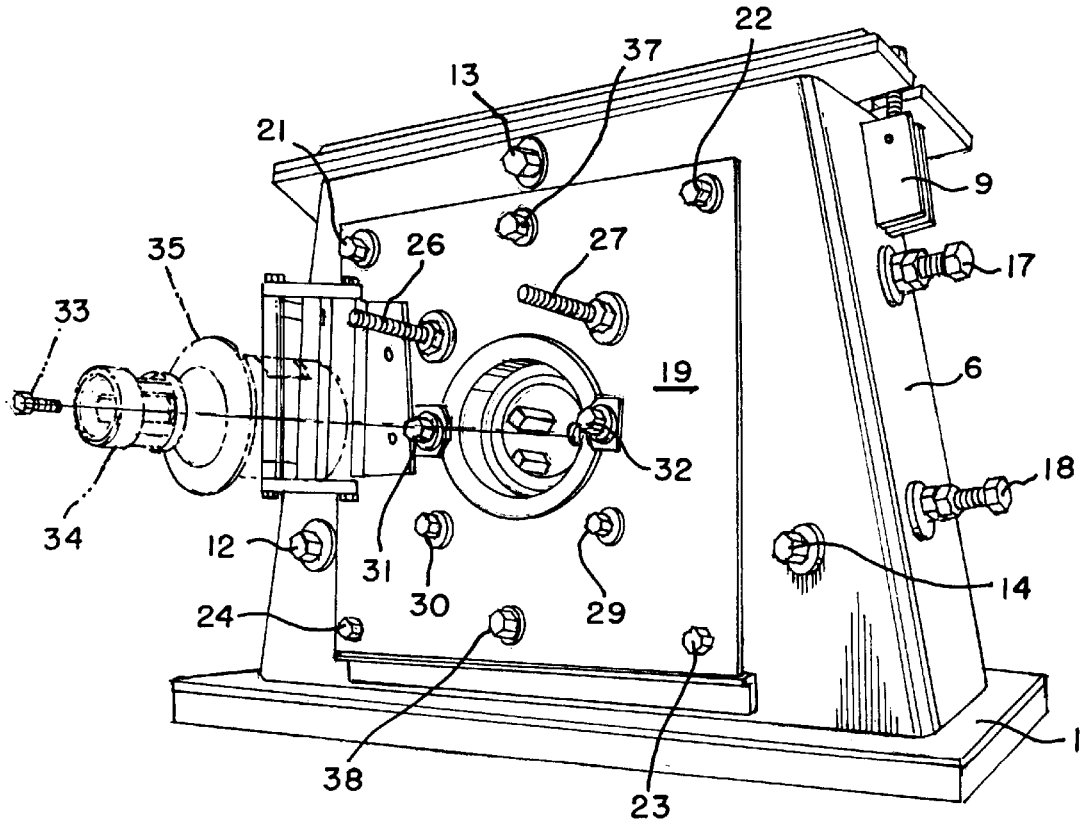
FIG. 2 is a perspective view showing removal of certain interior elements of the blast wheel apparatus.
Figure 3:
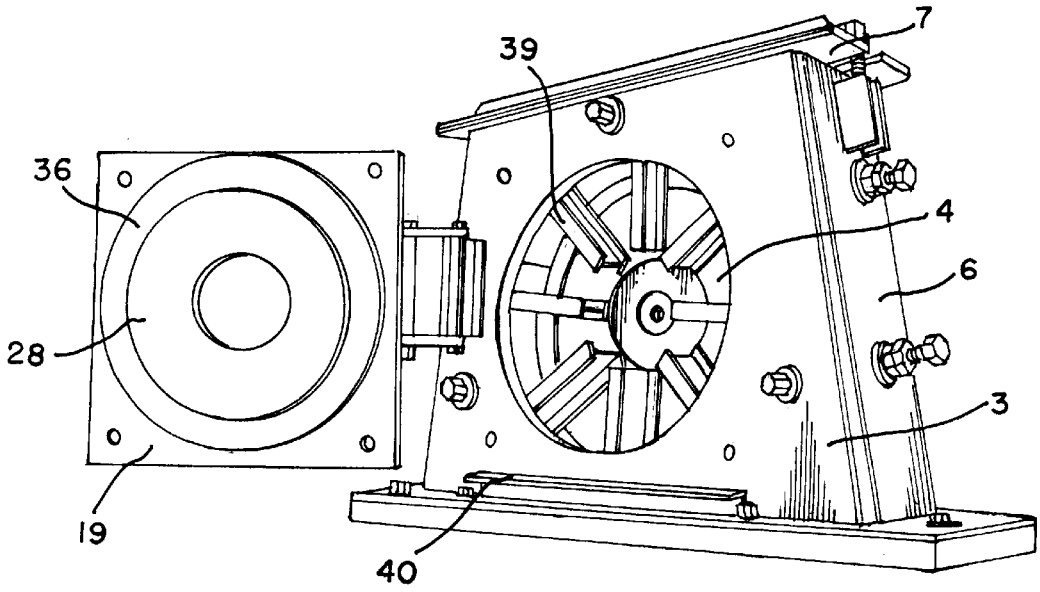
FIG. 3 is a perspective view showing the interior of the blast wheel housing.

In operation and for the purpose of inspecting and/or removing worn parts disposed within the blast wheel housing, feed chute 25 is first removed by means of loosening nut and washer assemblies 26 and 27. Then nut and tab assemblies 31 and 32 are loosened and bolt 33 is removed thereby allowing impeller 34 and control cage 35 to be removed from within the blast wheel housing, as best shown in FIG. 2. Following this, nuts 21–24 are removed so as to allow access door 19 to be swung open by means of hinge 20. The blast wheel housing then appears as depicted in FIG. 3. Also as shown in FIG. 3, heat treated ring 36 is disposed in face contacting relation with the backside of access door 19 and is held in place by nut and washer assemblies 37 and 38.

With the blast wheel housing disposed as shown in FIG. 3, the operator can visually inspect the interior protective liners for wear and, if replacement is necessary, the time consuming procedure of removing top 7 and swinging end walls 5 and 6 down is undertaken. Also, if the protective liners are not worn to the point of needing replacement, the ability to inspect the interior of the blast wheel housing, by this invention, prevents any unnecessary removal of top 7, of course, other interior elements of the blast wheel housing can be inspected through the opening in front wall 3 such as the wheel, hub and pins. Inspection of these is not possible through an open top without their complete removal from the housing.

Figure 4:
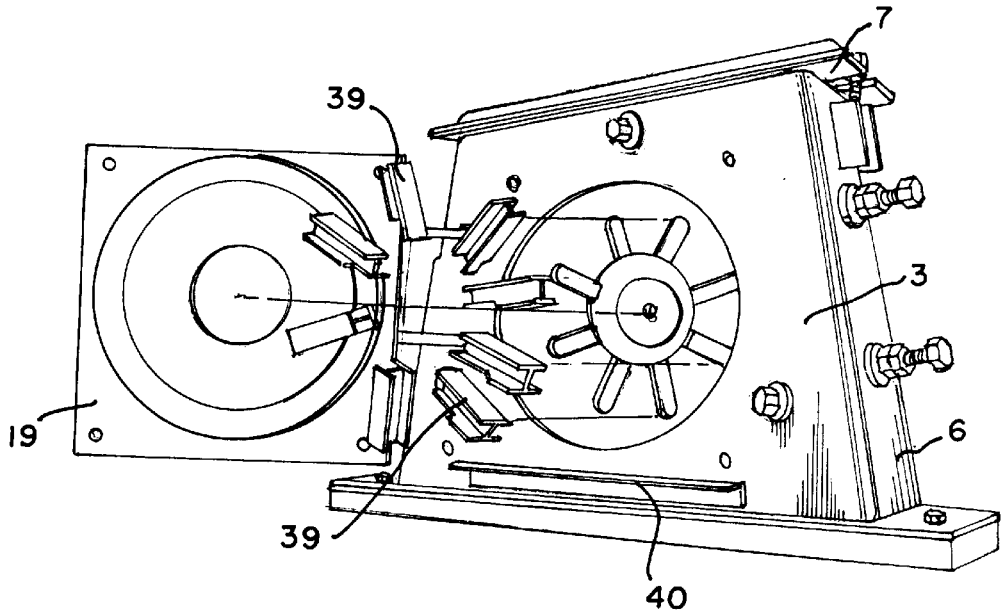
FIG. 4 is a perspective view depicting removal of the blast wheel blades.

If the inspection reveals that blades 39 must be replaced, they are simply loosened, removed and then replaced with new blades, in known manner, and as best shown in FIG. 4. Following replacement of blades 39, the sequence is simply reversed wherein access door 19 is closed and secured shut, impeller 34 and control cage 35 replaced and feed chute 25 placed back into position such that the blast wheel housing appears as shown in FIG. 1.

According to another feature of this invention, flange 40 is provided so that when access door 19 is closed, the bottom edge of door 19 slides across the upper surface of flange 40 in an abutting relationship therewith so as to allow access door 19 to be positioned in the proper orientation each time it is closed resulting in the precise alignment of impeller 34 and control cage 35 during the reinstallation process.

Therefore, by this invention, increased safety is attained and downtime is greatly reduced from the known time-consuming procedure of gaining access to the blast wheel housing by removal of the housing top and opening of the end walls. In addition, the access door is self-aligning so as to swing back into the desired position every time it is closed.

I claim:

1. A blast wheel housing comprising a baseplate, a front wall, a rear wall, a pair of end walls and a top secured together so as to form a housing enclosure, an opening formed in said front wall, an access door hingedly connected to said front wall so as to selectively cover said opening, an aperture formed in said access door, and a feed chute detachably secured to said access door for the purpose of feeding shot through said aperture.

2. A blast wheel housing according to claim 1 wherein a blast wheel disposed in said enclosure and driven by means of a drive motor.

3. A blast wheel housing according to claim 2 wherein multiple blades are detachably secured to said blast wheel and are removable through said aperture.

4. A blast wheel housing according to claim 1 wherein a flange is secured to said front wall and is disposed in abutting relationship with the lower edge of said access door when said access door is closed.

* * * * *